US006315917B1

(12) United States Patent
Shieh

(10) Patent No.: US 6,315,917 B1
(45) Date of Patent: Nov. 13, 2001

(54) USING ARL TO DECREASE EPD NOISE IN CMP PROCESS

(75) Inventor: Ming-Shiou Shieh, Taipei (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 09/223,408

(22) Filed: Dec. 30, 1998

(30) Foreign Application Priority Data

Sep. 23, 1998 (TW) ..... 87115816

(51) Int. Cl.[7] ..... B44C 1/22

(52) U.S. Cl. ..... 216/85; 216/88; 430/950; 438/7; 438/16

(58) Field of Search ..... 216/85, 88; 430/950; 438/7, 16

(56) References Cited

U.S. PATENT DOCUMENTS

| | | | | |
|---|---|---|---|---|
| 5,461,007 | * | 10/1995 | Kobayashi | 437/225 |
| 5,767,013 | * | 6/1998 | Park et al. | 438/622 |
| 6,010,538 | * | 1/2000 | Sun et al. | 216/91 |
| 6,028,669 | * | 2/2000 | Tzeng | 356/355 |
| 6,068,539 | * | 5/2000 | Bajaj et al. | 451/6 |
| 6,071,177 | * | 6/2000 | Lin et al. | 451/6 |

* cited by examiner

*Primary Examiner*—Randy Gulakowski
*Assistant Examiner*—Anita Alanko
(74) *Attorney, Agent, or Firm*—Jiawei Huang; J.C. Patents

(57) ABSTRACT

The invention provides a method for decreasing endpoint detection noise in a chemical-mechanical polishing process. In this method an anti-reflective layer is formed on the material whose reflected light interferes with the incident light. The anti-reflective layer can avoid light reflected by the material that would affect the detector. Thus, the end point of the chemical-mechanical polishing process can be easily verified and the quality of the devices is improved.

20 Claims, 1 Drawing Sheet

USING ARL TO DECREASE EPD NOISE IN CMP PROCESS

CROSS-REFERENCE TO RELATED APPLICATION

This application claims the priority benefit of Taiwan application Ser. No. 87115816, filed Sep. 23, 1998, the full disclosure of which is incorporated herein by reference.

BACKGROUND OF THE INVENTION

1. Field of the Invention

The present invention relates to a method of decreasing endpoint detection noise in a chemical-mechanical polishing process. More particularly, the present invention relates to a method of decreasing endpoint detection noise in a chemical-mechanical polishing process by using anti-reflective layer.

2. Description of the Related Art

Chemical-mechanical polishing is the only technique capable of providing the global planarization in VLSI process, and even in ULSI process.

A reflectometer or a spectometer is used as an end point detector in a chemical-mechanical polishing process. However, it is difficult to detect the end point when the incident light is reflected by the different material layers because the reflected lights of the different material layers interfere with each other.

FIG. 1 is a schematic, cross-sectional diagram used to depict the effect of the reflected light on end point detector in a chemical-mechanical polishing process.

A patterned material layer 12 is formed on a provided substrate 10. The material layer 12 having an opening 16 is formed by photolithographic etching. The opening 16 exposes the substrate 10. A thick material layer 14 is formed on the material layer 12 and fills the opening 16. The material of the material layer 12 and the material layer 14 are different. Chemical-mechanical polishing is performed to planarize the material layer 14. When an incident light $I_0$ from the end point detector such as a reflectometer or a spectometer irradiates the different material layers, different reflected lights are produced.

As shown in FIG. 1, the reflected light $I_1$ is produced when the incident light $I_0$ irradiates the material layer 12. The reflected light $I_2$ is produced while the incident light $I_0$ irradiates the substrate 10 exposed by the opening 16. During a chemical-mechanical polishing process, the end point is verified by using the reflected lights. The choice of the reflected lights is based on the material of the material layer 14. If the end point is verified by the change of the intensity of the reflected light $I_1$, the reflected light $I_2$ interferes with the reflected light $I_1$. Similarly, if the end point is verified by the change in the intensity of the reflected light $I_2$, the reflected light $I_1$ interferes with the reflected light $I_2$.

SUMMARY OF THE INVENTION

Accordingly, the present invention provides a method for decreasing endpoint detection noise in a chemical-mechanical polishing process by using an anti-reflective layer.

To achieve these and other advantages and in accordance with the purpose of the invention, as embodied and broadly described herein, the invention provides a method for decreasing endpoint detection noise in a chemical-mechanical polishing process. The method for decreasing endpoint detection noise in a chemical-mechanical polishing process includes following steps. An anti-reflective layer is formed on a provided substrate, wherein the reflection light of the substrate interferes with the incident light. A patterned first material layer and a second material layer are formed in sequence on the anti-reflective layer. Chemical-mechanical polishing is performed to planarize the second material layer. A detector is used to verify the end point.

To achieve these and other advantages and in accordance with the purpose of the invention, as embodied and broadly described herein, the invention provides another method for decreasing endpoint detection noise in a chemical-mechanical polishing process. The method for decreasing endpoint detection noise in a chemical-mechanical polishing process includes following steps. An anti-reflective layer is formed on a metal layer, wherein the reflection light of the metal layer interferes with the incident light. An opening is formed in the anti-reflective layer and the metal layer. A material layer is formed on the anti-reflective layer and fills the opening. Chemical-mechanical polishing is performed to planarize the second material layer. A detector is used to verify the end point.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
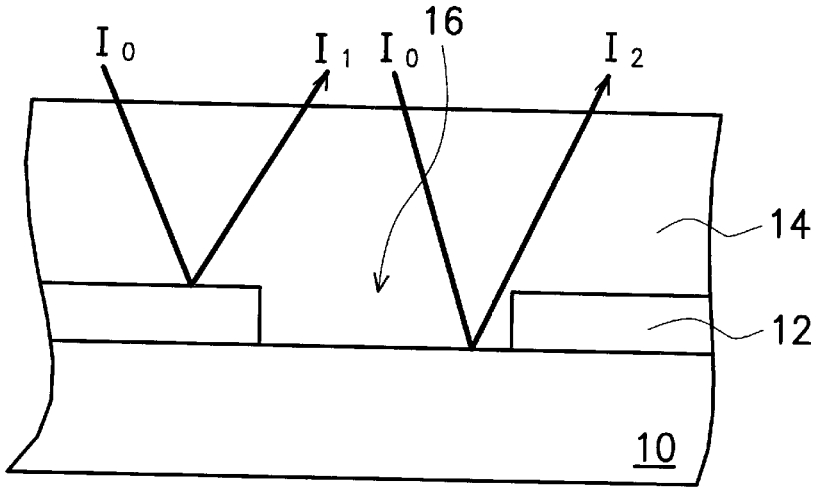
FIG. 1 (PRIOR ART)
FIG. 1 is a schematic, cross-sectional diagram used to depict the effect of the reflected light on an end point detector in a chemical-mechanical polishing process.

Reference will now be made in detail to the present preferred embodiments of the invention, examples of which are illustrated in the accompanying drawings. Wherever possible, the same reference numbers are used in the drawings and the description to refer to the same or like parts.

Figure 2:
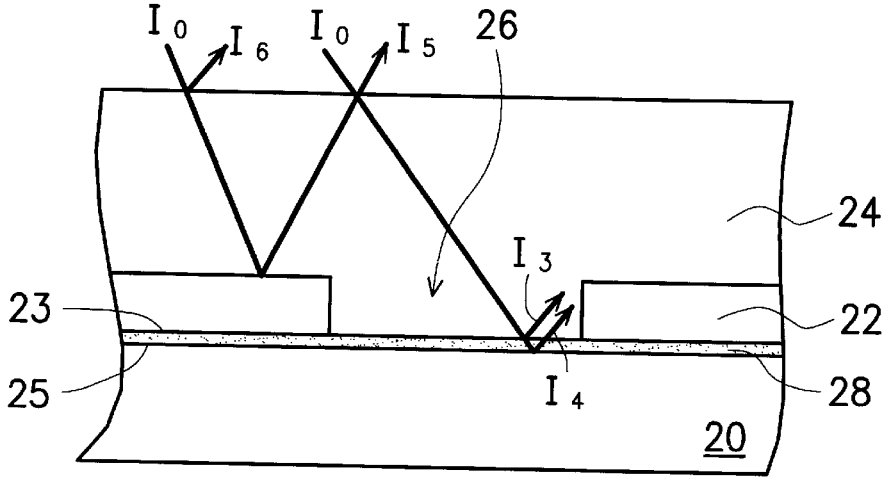
FIG. 2 is a schematic, cross-sectional diagram used to depict a method according to the invention for decreasing endpoint detection noise in a chemical-mechanical polishing process, wherein the noise is caused by a substrate.

FIG. 2 is a schematic, cross-sectional diagram used to depict a method according to the invention for decreasing endpoint detection noise in a chemical-mechanical polishing process, wherein the noise is caused by a substrate.

A substrate 20 having a MOS (not shown in FIG. 2) is provided. An anti-reflective layer 28 is formed on the substrate 20, wherein the reflection light of the substrate 20 interferes with the incident light $I_0$. This is a characteristic of the invention. The anti-reflective layer 28 includes dielectric material, for example, silicon-oxy-nitride or silicon nitride.

A patterned material layer 22 having an opening 26 is formed on the anti-reflective layer 28. The material layer 22 having an opening 26 is formed by photolithographic etching. The opening 26 exposes the anti-reflective layer 28.

A thick material layer 24 is formed on the material layer 22 and fills the opening 26. The material of the material layer 22 and the material layer 24 are different. The material layer 24 includes dielectric material.

Chemical-mechanical polishing is performed to planarize the material layer 24. During a chemical-mechanical polishing process, the change of the intensity of the reflected light $I_5$ and $I_6$ is used to verify the end point by a detector such as a reflectometer or a spectometer. The substrate 20 exposed by the opening 26 is covered by the anti-reflected layer 28, thus no undesired reflected light is produced. Because the incident light $I_0$ irradiates the first surface 23 and the second surface 25 of the anti-reflective layer 28, the reflected light $I_3$ and $I_4$ disappeare due to the interference of the reflected lights. Thus, the end point can be easily verified and the quality of the devices is improved.

Figure 3:
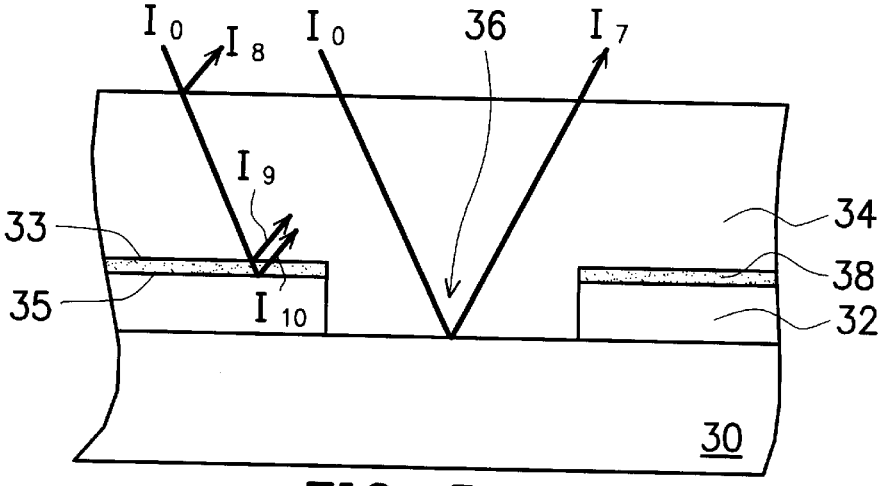
FIG. 3 is a schematic, cross-sectional diagram used to depict another method according to the invention for decreasing endpoint detection noise in a chemical-mechanical polishing process, wherein the noise is caused by a metal layer.

FIG. 3 is a schematic, cross-sectional diagram used to depict another method according to the invention for decreasing endpoint detection noise in a chemical-mechanical polishing process, wherein the noise is caused by a metal layer.

A substrate 30 having a MOS (not shown) is provided. A material layer 32 and an anti-reflective layer 38 are formed in sequence on the substrate 30, wherein the reflected light of the substrate 30 interferes with the incident light $I_0$. A characteristic of the invention is to form the anti-reflective layer 38 on the material layer 32. An opening 36 is formed in the material layer 32 and the anti-reflective layer 38 to expose the substrate 30 by photolithographic etching. The material layer 32 includes conductive material such as metal. The anti-reflective layer 38 includes conductive material, for example, titanium nitride or tungsten nitride. Also, the anti-reflective layer 38 can include dielectric material, for example, silicon nitride or silicon-oxy-nitride.

A thick material layer 34 is formed on the anti-reflective layer 38 and fills the opening 36. The material of the material layer 32 and the material layer 34 are different. The material layer 34 includes dielectric material.

Chemical-mechanical polishing is performed to planarize the material layer 34. During a chemical-mechanical polishing process, the change of the intensity of the reflected light $I_7$ and $I_8$ is used to verify the end point by a detector such as a reflectometer or a spectometer.

The material layer 32 is covered by the anti-reflective layer 38, and thus no undesired reflected light is produced. Because the incident light $I_0$ irradiates the first surface 33 and the second surface 35 of the anti-reflective layer 38, the reflected light $I_9$ and $I_{10}$ disappeare due to the interference of the lights. Thus, the end point can be easily verified and the quality of the devices improved.

The characteristic of the invention is to form an anti-reflective layer on the material whose reflected light interferes with the incident light. The anti-reflective layer can avoid undesired reflected light. Thus, the end point of the chemical-mechanical polishing process can be easily verified and the quality of the devices is improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for decreasing an endpoint detection noise in a chemical-mechanical polishing process, wherein the endpoint detection noise is caused by a light reflected from a substrate comprising:

forming an anti-reflective layer on a provided substrate;

forming a patterned first material layer on the anti-reflective layer, wherein a portion of the anti-reflective layer is exposed;

forming a second material layer on the first material layer; and performing a chemical-mechanical polishing process to planarize the second material layer until an end point is detected, wherein the end point is verified by using a detector for detecting a change in intensity of a light reflected from a top surface of the second material layer and a light reflected from a top surface of the first material layer.

2. The method of claim 1, wherein the chemical-mechanical polishing process is performed for polishing dielectric material.

3. The method of claim 1, wherein the anti-reflective layer includes a dielectric material.

4. The method of claim 1, wherein the anti-reflective layer includes silicon-oxy-nitride.

5. The method of claim 1, wherein the anti-reflective layer includes silicon nitride.

6. The method of claim 1, wherein the second material layer includes dielectric material.

7. The method of claim 1, wherein the detector includes a reflectometer.

8. The method of claim 1, wherein the detector includes a spectometer.

9. A method for decreasing an endpoint detection noise in a polishing process, wherein the noise is caused by an undesired reflection light from a layer, comprising the steps of:

forming a first material layer on a substrate;

forming an anti-reflective layer on the first material layer;

patterning the first material layer and the anti-reflective layer to form an opening that exposes a portion of the substrate;

forming a second material layer over the anti-reflective layer, wherein the opening is also filled; and performing a chemical-mechanical polishing process to planarize the second material layer until an end point is detected, wherein the end point is verified by using a detector for detecting a change in intensity of a light reflected from a top surface of the second material layer and a light reflected from the substrate within the opening.

10. The method of claim 9, wherein the chemical-mechanical polishing process is performed for polishing dielectric material.

11. The method of claim 9, wherein the anti-reflective layer includes a conductive material.

12. The method of claim 9, wherein the anti-reflective layer includes titanium nitride.

13. The method of claim 9, wherein the anti-reflective layer includes tungsten nitride.

14. The method of claim 9, wherein the anti-reflective layer includes a dielectric material.

15. The method of claim 9, wherein the anti-reflective layer includes silicon nitride.

16. The method of claim 9, wherein the material layer includes silicon-oxy-nitride.

17. The method of claim 9, wherein the material layer includes a dielectric material.

18. The method of claim 9, wherein the detector includes a reflectometer.

19. The method of claim 9, wherein the detector includes a spectometer.

20. A method of reducing noise in endpoint detection, the method comprising:

providing a substrate;

forming an anti-reflective layer over the substrate;

forming a first material layer on the anti-reflective layer, the first material layer having an opening that exposes a portion of the anti-reflective layer;

forming a second material layer on the first material and filling the opening; and performing a chemical-mechanical polishing process on the second material layer until an end point is detected, wherein the end point is determined by measuring a light intensity reflected from a top surface of the first material layer and a light intensity reflected by a top surface of the second material layer, while a light intensity reflected from the anti-reflective layer within the opening is eliminated.

* * * * *